US006125592A

United States Patent [19]

Hickey et al.

[11] Patent Number: 6,125,592

[45] **Date of Patent: *Oct. 3, 2000**

[54] TILE ROOF CONSTRUCTION

[75] Inventors: Michael J. Hickey, Irvine; James E. Lee, Fountain Valley; Robert Ward, Signal Hill, all of Calif.

[73] Assignee: Newport Fastner Company, Inc., Anaheim, Calif.

[ * ] Notice: This patent is subject to a terminal disclaimer.

[21] Appl. No.: 09/351,713

[22] Filed: Jul. 12, 1999

Related U.S. Application Data

[63] Continuation of application No. 08/748,006, Nov. 12, 1996, Pat. No. 5,921,045, which is a continuation of application No. 08/409,172, Mar. 23, 1995, abandoned.

[51] Int. Cl.[7] ..... E04D 1/34

[52] U.S. Cl. ..... 50/543; 52/547; 52/549; 52/551; 52/713

[58] Field of Search ..... 52/543, 544, 546, 52/547, 549, 551, 554, 713

[56] References Cited

U.S. PATENT DOCUMENTS

| | | | |
|---|---|---|---|
| 978,334 | 12/1910 | Overbury . | |
| 1,523,472 | 1/1925 | Bobbitt . | |
| 1,574,099 | 2/1926 | Kridler . | |
| 1,952,317 | 3/1934 | Holder . | |
| 2,025,983 | 12/1935 | Harrington . | |
| 2,057,819 | 10/1936 | Corcoran . | |
| 2,084,609 | 6/1937 | Corcoran . | |
| 2,152,080 | 3/1939 | Munsey . | |
| 2,475,795 | 7/1949 | Lockwood . | |
| 4,426,823 | 1/1984 | Kobe . | |
| 5,079,889 | 1/1992 | Wright . | |
| 5,921,045 | 7/1999 | Hickey et al. | 52/543 |

FOREIGN PATENT DOCUMENTS

| | | | |
|---|---|---|---|
| 150179 | 7/1937 | Austria . | |
| 43991 | 9/1934 | France . | |
| 406093685 | 4/1994 | Japan | 52/543 |
| 355922 | 9/1961 | Switzerland . | |

OTHER PUBLICATIONS

The Advantages and Exclusive Features of Riness Tile Tie, by San Valle Tile Kilns, Tile Tie Systems, 1967.

Tyle–Tie, Tile Roofs, Tile Tie Systems, 1967.

Patent Application of W. McMurray for Roof Tile Anchoring System (1969).

Patent Application of W. McMurray of Tile Tie (1973).

Tile Roof Fastening Methods, by Newport Fastener, 1994, pp. 1–8.

"A Tile Roof is One Roof That Doesn't Have to be Nailed On" flyer by Tyle–Tye (Before 1975).

Tyle–Lok . . . A Way to Make Any Tile Roof Even More Secure, flyer distributed by San Valle Tile Kilns (Before 1975).

Roofs of Tile flyer by Riness Tile Tie Company (Before 1940).

Not One Leak Has Ever Occurred On a Roof Using Tyle–Tye flyer by Tyle–Tie (Before 1947).

Tuix System, Modular system for the fixing and ventilation of the bent tiles brochure by Fornace Olivi Mission Tile & One Piece Mission Tile, 1969.

"Nail–Lok" flyer distributed by San Valle Tile Kilns (Before 1976).

(List continued on next page.)

*Primary Examiner*—Richard Chilcot
*Attorney, Agent, or Firm*—Price, Gess & Ubell

[57] ABSTRACT

A two-part fastening mechanism employing (1) a continuous metal strip having attachment slots whose axes are oriented parallel to the length of the strip, and (2) a single preformed metal connector piece having a longitudinally-oriented hook for gripping one end of a tile and a stem portion insertable into one of the slots in the metal fastening strip and bendable over the slot and back upon itself for retaining the connector piece attached to the continuous metal strip. When installed, the fastening mechanism holds each tile in two places: at a first end via the hook, and at an opening in the tile where the connector piece passes through.

9 Claims, 2 Drawing Sheets

OTHER PUBLICATIONS

Roofs of Tile, by Tile Tie Systems.

"Tyle–Tie and Riness Tyle–Tye Systems" brochure, distributed by San Valle Tile Kilns (Before 1975).

"A Tile Roof Is One Roof that Should Not Be Nailed to the Roofing" flyer by Tyle–Tye (Before 1975).

Riness Tile Tie, "The Tie That Binds" brochure by Gills & Ellis (Before 1975).

35
31
θ
d
23
25
27
21
201
19
17
11
15
13
L
29
47
39
41
36
35
44
28
24

TILE ROOF CONSTRUCTION

This application is a continuation of Ser. No. 08/748,006 filed Nov. 12, 1996 now U.S. Pat. No. 5,921,045, which is a continuation of Ser. No. 08/409,172 filed Mar. 23, 1995 now abandoned.

BACKGROUND OF THE INVENTION

1. Field of the Invention

The subject invention relates generally to tile roof construction and more particularly to a tile roof construction employing a continuous metal strip and interfitting tile-retaining connector pieces.

2. Description of Related Art

Concrete and clay tiles have been used as a roof covering dating back to ancient Grecian times. A tile roof is fireproof, weatherproof, and an excellent insulating medium and, when laid properly, will last indefinitely. Properly installed, a tile roof can last a lifetime without breaking loose during high winds or earthquakes while, at the same time, protecting the waterproof membrane underneath. Today, roofing tiles come in a variety of shapes and sizes and are manufactured from either traditional clay or concrete.

Modern conditions have caused tile manufacturers, public safety commissions, building departments, as well as architects and engineers to demand greater security in roof tile installations, as well as in all phases of the building arts which affect public safety. Thus, it has proved desirable to securely fasten each roofing tile to the roof deck. Any such fastening system must take into account the considerable weight and varying dimensions of roofing tiles. One piece of clay or concrete roofing tile weighs between 5 and 10 pounds per tile. Each tile type is different and tile dimensions often vary from manufacturer to manufacturer.

Modern tile fastening systems typically employ tie wire networks for attaching the tile to the roof. The tie wire is conventionally 0.062-inch-diameter soft temper tie wire. One such system has employed a sheared extruded metal strip providing fastening loops of a semicircular section and profile oriented such that the axes of the loops are parallel to one another and perpendicular to the length of the strip. Tiles are tied to the loops 49 by such wire which must be soft temper tie wire, which is manually twisted several times during installation. For extra holding power, so-called Wind Locks and/or Hurricane Clips have been used in conjunction with the fastening system. Despite advantages of such systems, installation is still relatively complex and expensive.

SUMMARY OF THE INVENTION

It is therefore an object of the invention to improve roof tile fastening systems;

It is another object of the invention to provide a roof tile fastening system which is capable of holding tiles in place in the face of high winds, while still exhibiting the flexibility required to withstand earthquakes; and It is another object of the invention to provide such a system which is much simpler and quicker to install than prior art systems.

These and other objects and advantages are provided according to the invention by a two-part fastening mechanism employing (1) a continuous metal strip having attachment slots whose axes are oriented parallel to the length of the strip, and (2) a single preformed metal connector piece having a longitudinally-oriented hook for gripping one end of a tile and a stem portion insertable into one of the slots in the metal fastening strip and bendable over itself for retaining the connector piece attached to the continuous metal strip. When installed, the fastening mechanism holds each tile in two places: at a first end via the hook, and at an opening in the tile where the connector piece passes through. The connector piece is preferably fabricated of material much thicker than prior art twisted tie wire, e.g., 0.090-inch (2.3 mm) in diameter and, according to the invention, is bent over by a single turn, avoiding the labor-intensive multiple twisting of the prior art. The system further has the advantages of a nonrigid system, thus being earthquake-resistant while providing extra holding power.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figures 1, 2, 3:
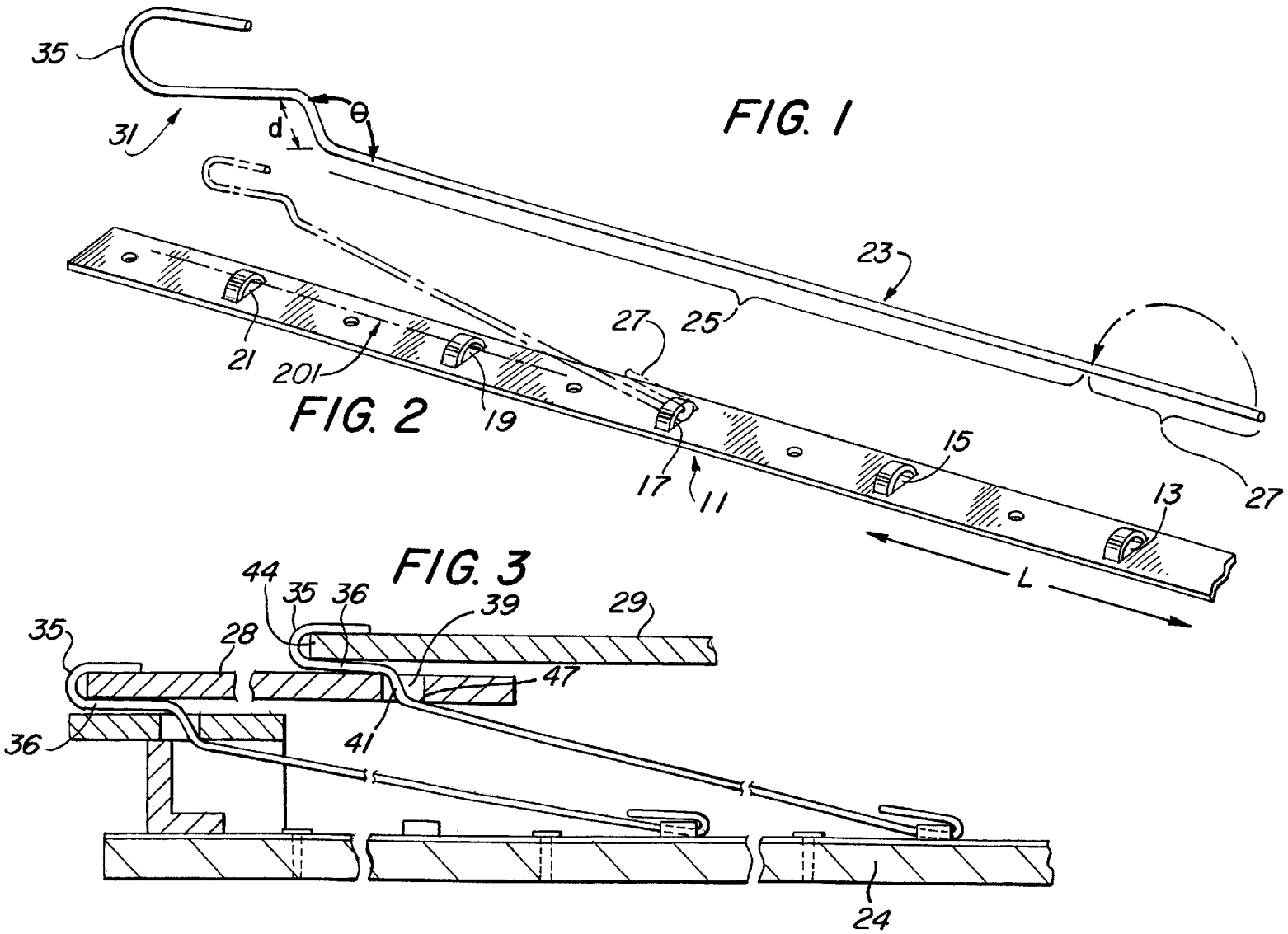
FIG. 1 is a perspective view of a connector piece according to the preferred embodiment of the invention.
FIG. 2 is a perspective view of a continuous metal strip according to the preferred embodiment.
FIG. 3 is a side sectional view illustrating installation of roofing tile according to the preferred embodiment.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a readily manufacturable and easily installed tile roof fastening system.

According to the preferred embodiment of FIGS. 1–4, a sheared extruded metal strip 11 is provided having a number of slots 13, 15, 17, 19, 21 formed therein. The slots 13, 15, 17, 19, 21 may have a semicircular section and profile in which case the centers of the semicircles may be disposed so as to lie on a common line 201 parallel to the length "L" of the strip 11. The strip 11 is further preferably fabricated of Type 300 stainless steel and may be formed on reels and cut to length, a useful and preferred length being 10 feet. The strip 11 is preferably 1 inch (24.5 mm) wide and 0.029 inch (0.25 mm) thick. The strips 11 may be fastened to a roof 24 (FIGS. 3, 4) by conventional means such as stainless steel or FM ("Factory Mutual") approved noncorrosive screws, or coated roofing fasteners.

To retain associated roofing tiles, e.g., 28, 29 in place, an elongated connector piece 23 is provided, as shown in FIG. 1. The connector piece 23 has a rod-like central portion 25, which terminates in a stem or fastening portion 27, which may be bent over, as indicated in phantom in FIG. 2. At the opposite end 31 of the connector piece 23, the rod-like central portion 25 angles upward at an obtuse angle $\Theta_1$, which may be, for example, approximately 120 degrees for a distance "d." The rod 23 then turns 90 degrees into a horizontal, generally U-shaped hook 35. The distance "d" is preferably selected such that the angled portion 41 of length "d" passes through a hole 39 in a roofing tile 29 (FIG. 3), permitting one side 36 of the hook 35 to lie substantially parallel to the top face of tile 28. Thus, the connector piece 23 extends through the hole 39 in the roofing tile 29 such that the U-shaped hook 35 rests on the surface of the tile 28 and receives and retains the end 44 of the overlying tile 29. The connector piece 23 is preferably cold-formed of 0.090-diameter Type 300 stainless steel wire.

The connector piece 23, in combination with the slots 15, 17, 19, etc., provides extreme ease of assembly, by direct insertion of the stem 27 parallel to the length "L" of the metal strip 11, while the U-shaped hook 35 provides secure retention of the tiles 28, 29. A particular tile 29 thus receives retaining or holding support at one end 44 and at the point 47 where the stem of the hook 35 engages the tile, e.g., adjacent the lower edge of the hole 39.

Figure 4:
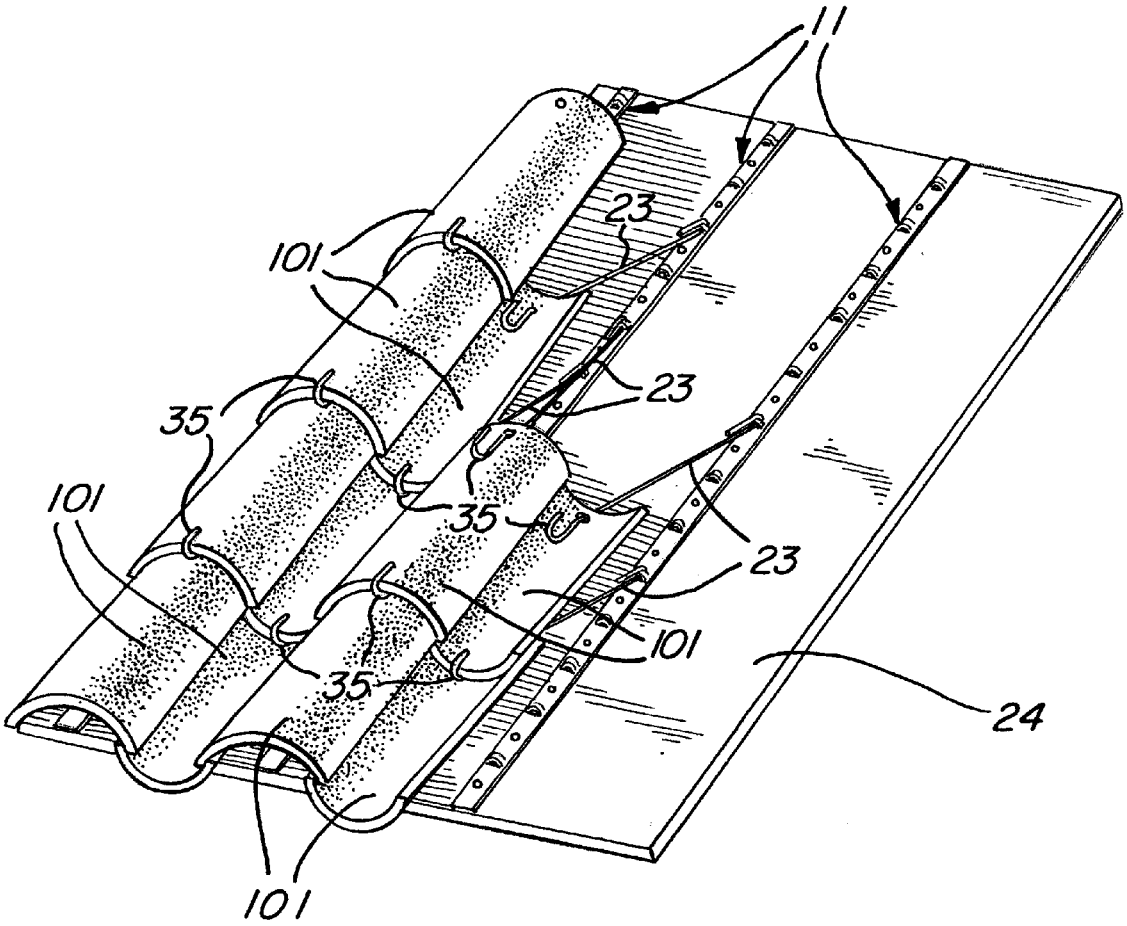
FIG. 4 is a perspective view further illustrating installation of roofing tile according to the preferred embodiment.

The application of the system of the preferred embodiment is further illustrated in FIG. 4 wherein a plurality of tiles 101 are fastened by a system comprising a plurality of strips 11 laid parallel to one another and attached to the tiles 101 by connector pieces 23 in the manner particularly illustrated in FIGS. 2 and 3.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A system for attaching roofing tiles to a roof, the system comprising:

a plurality of elongated metal strips arranged in parallel to one another on a roof, each strip having an edge, each edge having a length, the edges of each said strip lying parallel to one another; and a plurality of slots spaced apart from one another along the length of each of said strips, each slot having an opening therein, each opening having a center, each said center being oriented on a common line passing through the openings in said slots in a direction parallel to the length of the strip.

2. The system of claim 1 further comprising a plurality of tile fastening components, each component attached to one of said slots.

3. A roof tile fastening apparatus comprising:

a continuous metal strip having a length and a plurality of attachment slots, each slot having an opening therein, each slot being spaced apart along the length of the strip; and wherein the openings of the slots are oriented such that a linear stem portion of a metal connector piece can be inserted along a direction parallel to the length of the strip.

4. The roof tile fastening apparatus of claim 3 wherein each slot includes an opening with a center, each said center being oriented on a common line passing through the openings in the slots in a direction parallel to the length of the strip.

5. The system of claim 3 further comprising a plurality of tile fastening components, each component attached to one of said slots.

6. The system of claim 4 further comprising a plurality of tile fastening components, each component attached to one of said slots.

7. A system for attaching roofing tiles to a roof comprising:

a plurality of metal strips for disposal in parallel on a roof, a plurality of slots formed at intervals along each of said strips, each slot having an opening therein oriented with respect to its respective strip, such that a straight stem portion of a roof tile connector piece is directly insertable through said opening by insertion along a path having a horizontal component generally parallel to the length of the respective strip.

8. A roof tile fastening mechanism for fastening roof tiles comprising:

a continuous metal strip having length, a width and a plurality of attachment slots spaced apart from one another down the length of said strip; and an opening in each slot, each said opening being oriented on a common line passing through all the other openings in a direction parallel to the length of the strip.

9. The system of claim 7 further comprising a plurality of tile fastening components, each component attached to one of said slots.

* * * * *